US005320281A

United States Patent [19]

Hartmann et al.

[11] Patent Number: 5,320,281

[45] Date of Patent: Jun. 14, 1994

[54] HOUSING FOR A HIGH-PRESSURE CLEANING APPARATUS

[75] Inventors: Werner Hartmann, Ostfildern; Karl-Heinz Klöpfer, Winnenden; Gerhard Zerrer, Korb, all of Fed. Rep. of Germany

[73] Assignee: Andreas Stihl, Waiblingen, Fed. Rep. of Germany

[21] Appl. No.: 925,169

[22] Filed: Aug. 6, 1992

[30] Foreign Application Priority Data

Aug. 6, 1991 [DE] Fed. Rep. of Germany ... 9109717[U]

[51] Int. Cl.[5] ..... B05B 9/08

[52] U.S. Cl. ..... 239/154; 239/289; 239/525; 239/532; 220/4.26

[58] Field of Search ..... 239/525, 532, 152, 154, 239/147, 351, 375, 289; 206/229, 373; 220/4.26

[56] References Cited

U.S. PATENT DOCUMENTS

| | | | |
|---|---|---|---|
| 2,606,701 | 8/1952 | Huthsing | 239/154 |
| 2,752,200 | 6/1956 | Santarelli | 239/154 |
| 3,904,116 | 9/1975 | Jones et al. | 239/532 |
| 4,781,329 | 11/1988 | Tenney et al. | 239/351 |
| 4,810,169 | 3/1989 | Kranzle | 239/325 |
| 5,071,069 | 12/1991 | Stirm | 239/525 |

FOREIGN PATENT DOCUMENTS

| | | | |
|---|---|---|---|
| 662071 | 4/1963 | Canada | 239/351 |
| 1169827 | 6/1984 | Canada | 239/154 |
| 253357 | 2/1947 | Switzerland | 206/229 |

*Primary Examiner*—Kevin P. Shaver
*Assistant Examiner*—Christopher G. Trainor
*Attorney, Agent, or Firm*—Walter Ottesen

[57] ABSTRACT

The invention is directed to a housing for a high-pressure cleaning apparatus for accommodating a high-pressure pump, drive motor and other components of the apparatus coacting therewith. The apparatus is equipped with a cleaning lance which is held on the housing. The housing includes a trough-like lower housing half having a base wall adapted to support the pump and the motor and a trough-like upper housing half for closing off and covering the lower housing. The upper housing half has a top wall defining an outer side facing away from said base wall and a carrying handle is disposed on this outer side to enable an operator to carry the apparatus. The carrying handle is configured as a holder for holding the cleaning lance.

17 Claims, 9 Drawing Sheets

HOUSING FOR A HIGH-PRESSURE CLEANING APPARATUS

FIELD OF THE INVENTION

The invention relates to a housing for a high-pressure cleaning apparatus which accommodates a high-pressure pump, the drive motor therefor and the like.

BACKGROUND OF THE INVENTION

High-pressure cleaning apparatus of the kind referred to above, which have a lower power, are used to an ever increasing extent by individual consumers. These apparatus are intended to be small, compact and configured so that they can be easily manipulated. A suitable holder for the cleaning lance is desirable in order to permit storing the lance during work interruptions and without danger of causing damage. Also, accessory parts such as cleaning brushes, bottles containing cleaning agents or the like should be accommodated so that they can be conveniently grasped by the operator.

SUMMARY OF THE INVENTION

It is an object of the invention to configure a housing for a high-pressure cleaning apparatus in such a manner that a simple, operationally correct and reliable holder is provided for the cleaning lance.

The housing of the invention for a high-pressure cleaning apparatus is for accommodating a high-pressure pump, drive motor and other components of the apparatus coacting therewith. The apparatus has a cleaning lance and the housing of the invention includes: a trough-like lower housing half having a base wall adapted to support the pump and the motor; a trough-like upper housing half for closing off and covering the lower housing half; the lower and upper housing halves conjointly defining a horizontal partition interface where the housing halves are mutually joined; the upper housing half having a top wall defining an outer side facing away from the base wall; a carrying handle disposed on the outer side for enabling an operator to carry the apparatus; and, the carrying handle being configured as a holder for holding the cleaning lance.

The housing is configured so as to be simple and to save space. The carrying handle is configured so that it functions as a holder for the cleaning lance in addition to its function as a carrying handle. This affords the advantage that the cleaning lance is simultaneously held when grasping the carrying handle so that the lance cannot slip out of the holder. During work interruptions, the cleaning lance can be placed on the carrying handle in a simple manner where it is held so that it cannot tilt and without danger of causing damage.

Preferably, the holder is configured in the region of the handle bridge as a support having the form of a half shell. The support is open at its ends and is adapted with respect to its receiving width to the tube diameter of the cleaning lance. The carrying handle includes handle posts provided at the ends of the handle bridge. Receptacles are formed in the handle posts which are extensions of the support and have a receiving width greater than the receiving width of the support itself. This affords the advantage that annular shoulders are provided at the transition to the half shell in the handle bridge. The annular shoulders serve as a stop for the handle of the cleaning lance on the one hand and for the connecter at the forward end of the cleaning lance. The cleaning lance is in this way secured against slipping in its axial direction out of the holder.

According to another embodiment of the invention, receptacles are formed in one longitudinal side of the housing which are open toward the longitudinal side for receiving accessories such as a cleaning brush, a flask containing cleaning agent or the like. These receptacles are open in the vertical direction facing toward the carrying handle so that the accessories can be inserted vertically from above from the side of the carrying handle and can be held so as to be clearly visible. In this way, the accessory parts are always immediately available for grasping by the operator and are reliably held during transport of the high-pressure cleaning apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
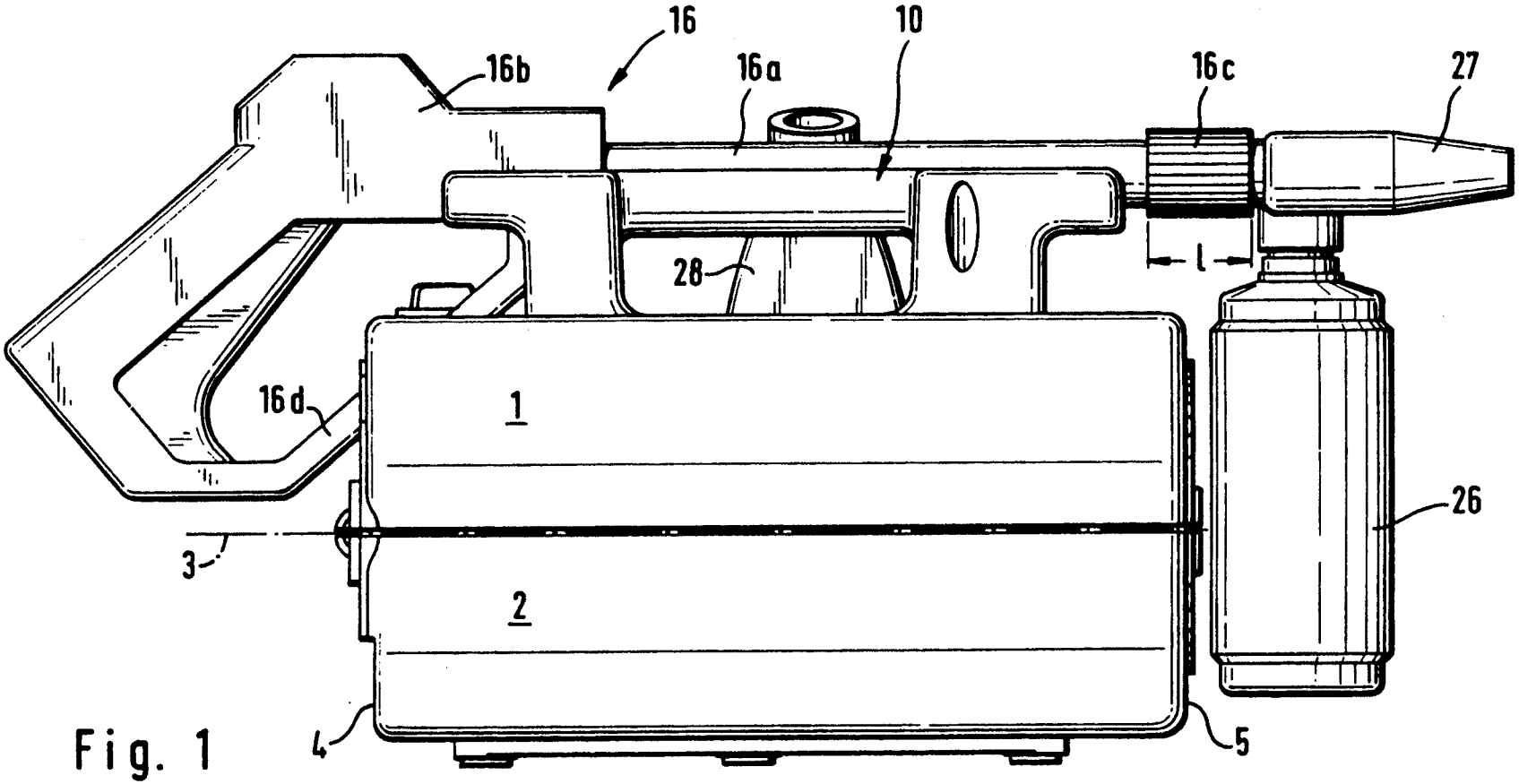
FIG. 1 is a side elevation view of the housing of the invention for a high-pressure cleaning apparatus with the cleaning lance being held on the housing.
Figure 2:
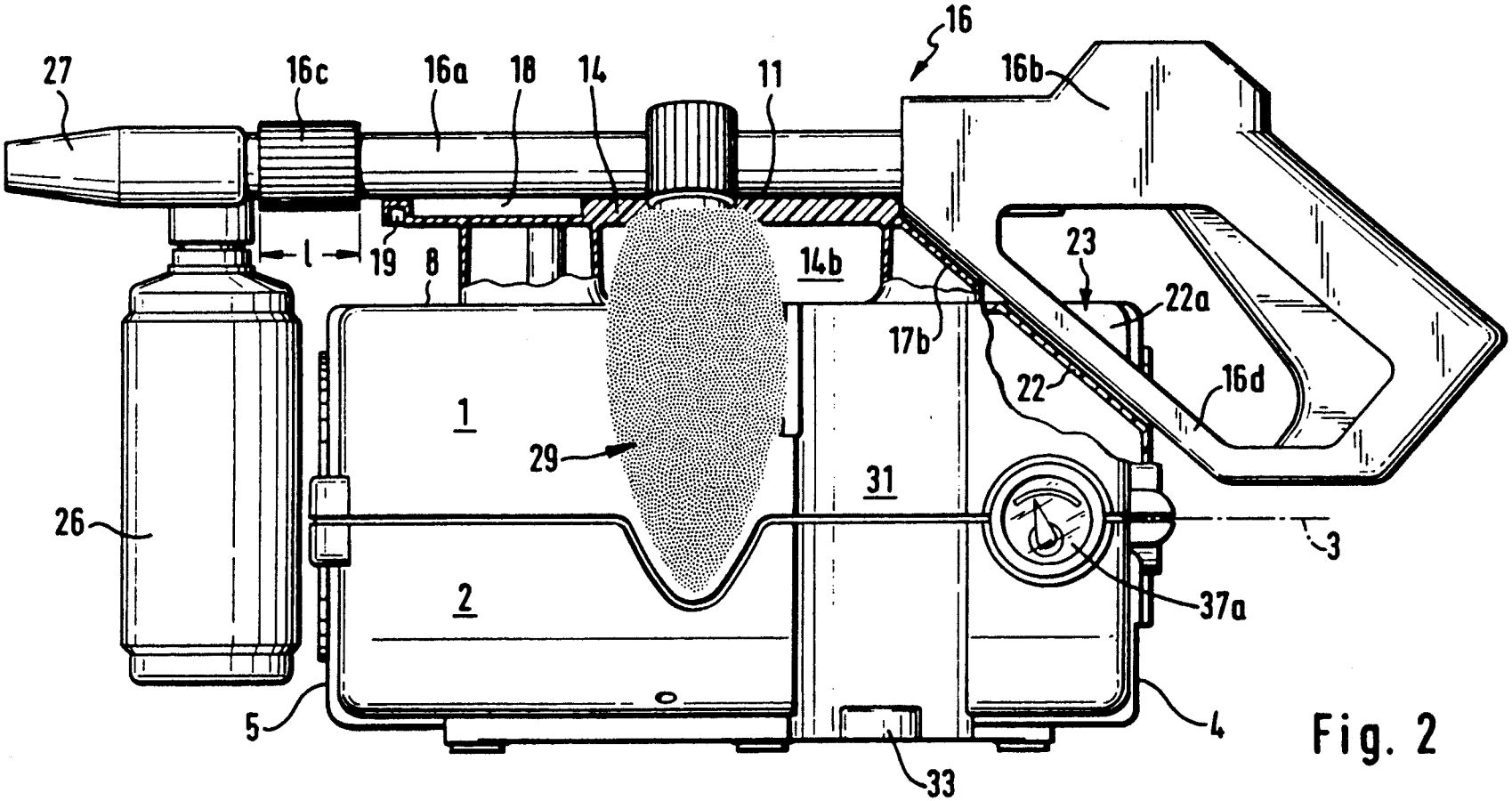
FIG. 2 is a side elevation view of the housing viewed from the other longitudinal side thereof.
Figure 3:
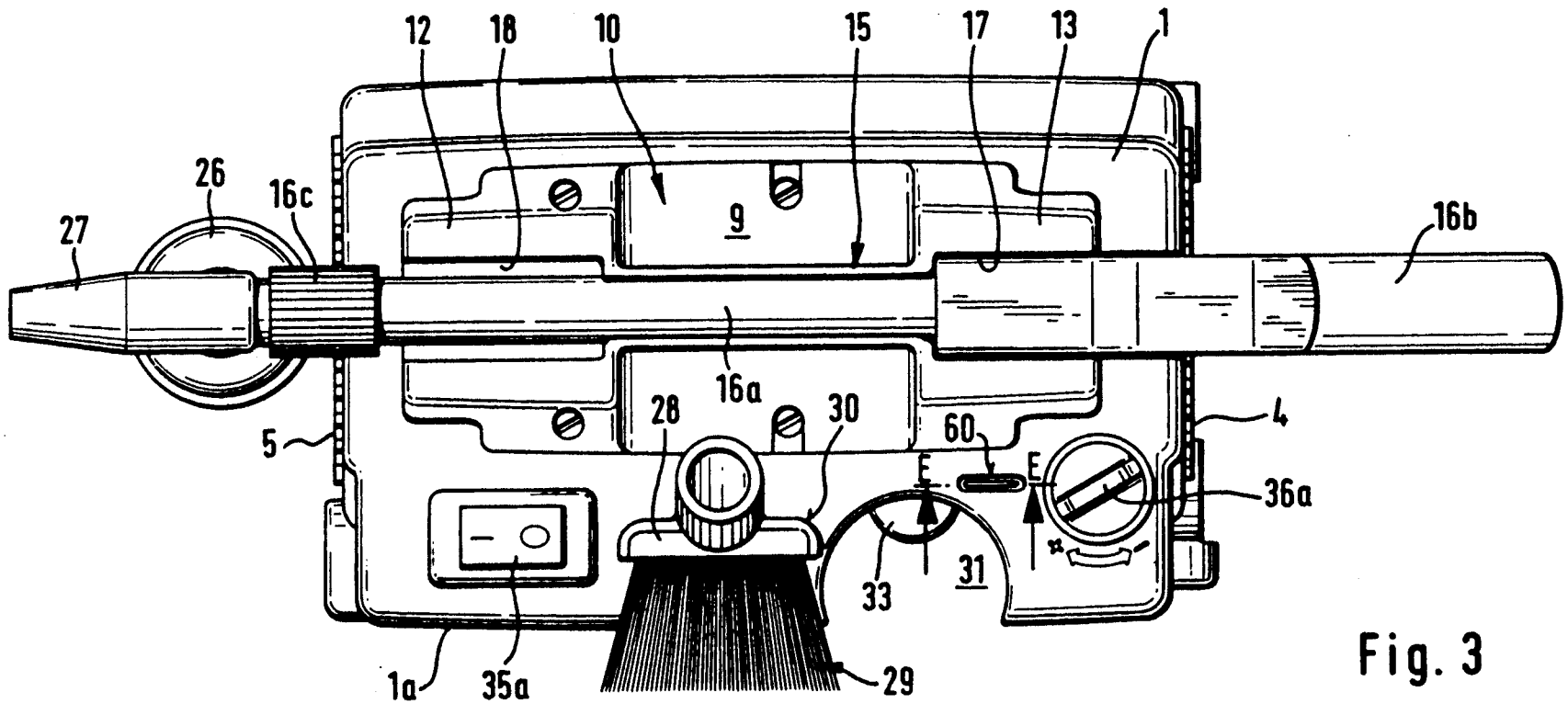
FIG. 3 is a plan view of the housing of FIG. 2.

The housing shown in FIGS. 1 to 3 is preferably made of plastic and is for a high-pressure cleaning apparatus. The housing has a basic shape corresponding essentially to a right parallelopiped and comprises an upper housing half 1 and a lower housing half 2 which are connected to each other at a partition plane 3 which lies horizontally with respect to the housing as shown. The housing is essentially closed on all sides and has air-inlet and air-outlet openings at its narrow end faces 4 and 5 with these openings having a lattice configuration.

As shown in FIGS. 4 to 7, the housing halves 1 and 2 are configured so as to be trough-like with the base 6 of the lower trough-like housing half being configured as a support for the components of the high-pressure cleaning apparatus, namely, for the high-pressure pump, the drive motor for the pump, a cooling fan and the like. Appropriate attachment points 7 are provided in the base 6.

The upper housing half 1 (FIG. 4) closes on the lower housing half 2 in the manner of a cover as shown in FIG. 1. A carrying handle 10 is fixed to the outer surface 8 of the cover facing away from the lower housing half 2. The carrying handle 10 is directed so as to be parallel to the longitudinal axis of the housing.

Figure 9:
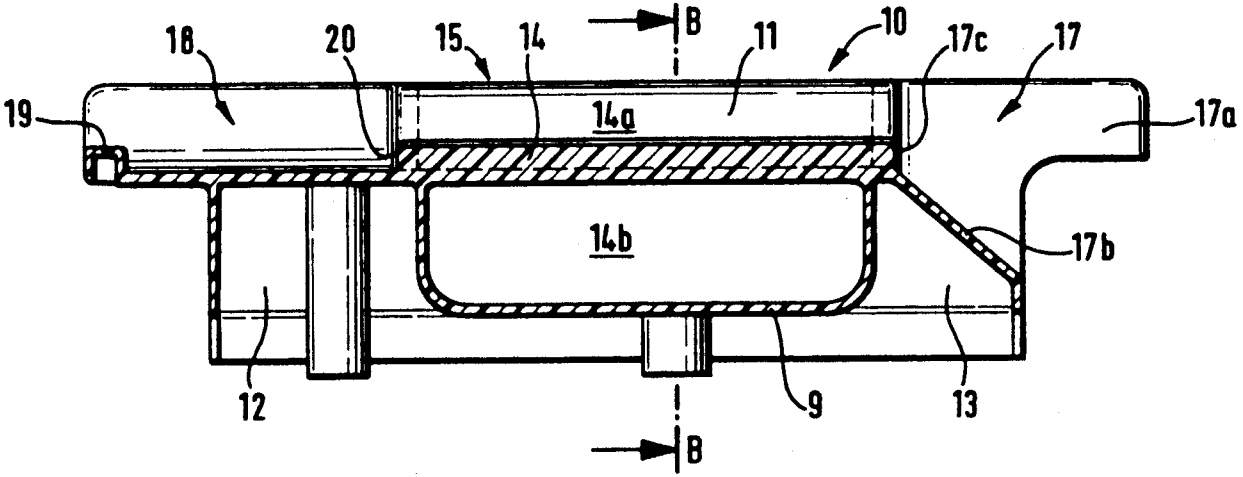
FIG. 9 is a section view taken along line A—A of FIG. 8.
Figure 8:
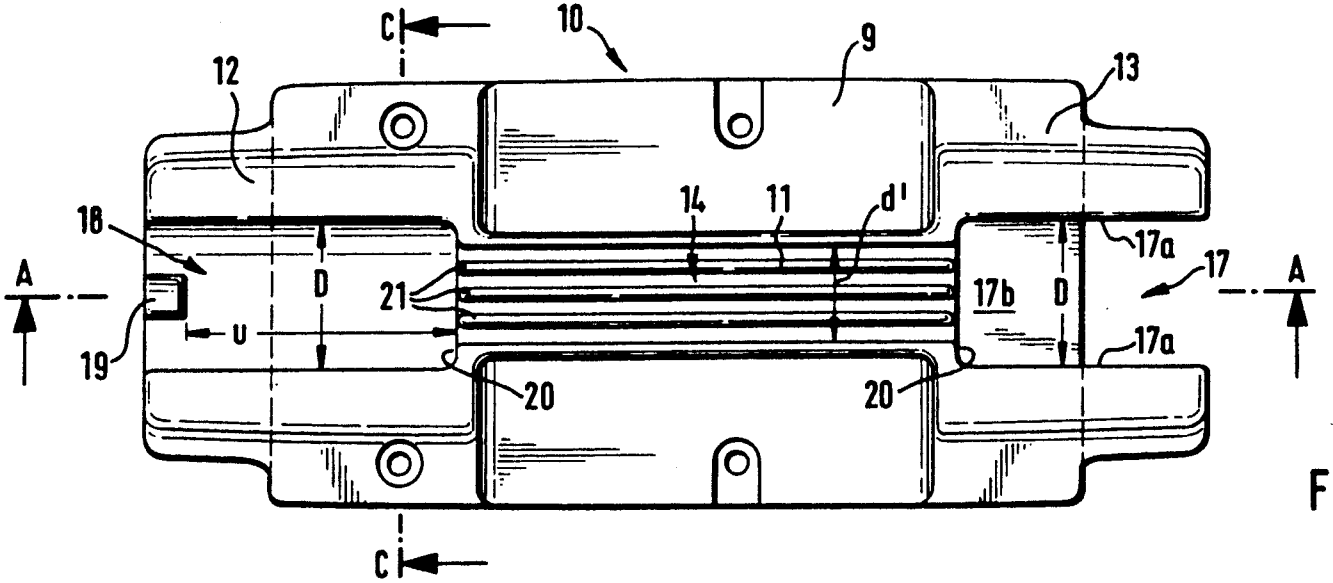
FIG. 8 is a plan view of the carrying handle of the housing.

As shown in FIGS. 8 and 9, the carrying handle 10 includes a base plate 9 which is configured so as to be rectangular as shown in the plan view of FIG. 8. The narrow ends of the rectangle lie next to the end faces 4 and 5 of the housing. Handle posts 12 and 13 are arranged on the base plate 9 adjacent respective end faces 4 and 5. The handle posts carry a handle bridge 14 which is disposed in spaced relationship to the base plate 9 whereby a pass-through 14*b* is provided for the hand of the operator carrying the apparatus.

Figure 10:
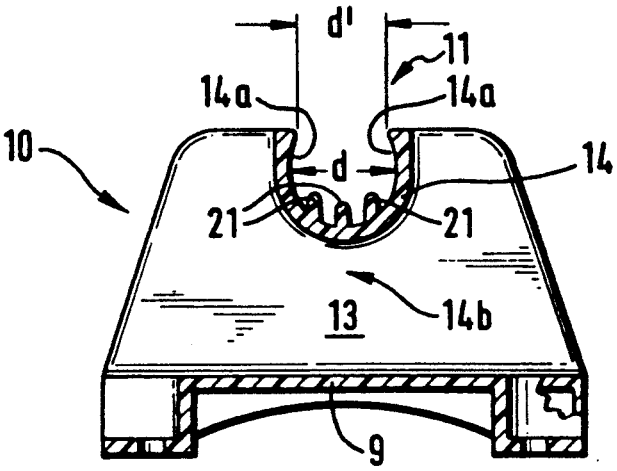
FIG. 10 is a section view taken along line B—B of FIG. 9.

The carrying handle 10 has a holder 15 disposed in the longitudinal direction of the housing and in the longitudinal direction of the carrying handle for accommodating a cleaning lance 16. In the region of the handle bridge 14, the holder 15 comprises a support 11 configured as a half shell (FIG. 10). The holder is open at its ends lying in the longitudinal direction. The ends of the holder 11 extend into receptacles 17 and 18 which are configured in the handle posts 12 and 13, respectively. The receptacles 17 and 18 are open at their ends facing away from the handle bridge 14 so that the cleaning lance 16 extends through the holder 15 in the carrying handle 10.

The cleaning lance 16 comprises essentially a tubular segment 16*a* having first and second ends with a pistol-shaped handle 16*b* being formed on one of the ends and a connecter 16*c* being provided at the other one of the ends for accommodating a cleaning tool or the like.

The half shell of the handle bridge 14 has a lower receptacle width (d) which corresponds to the outer diameter of the tube segment 16*a* so that the tube segment 16*a* can be placed from above into the handle bridge 14 with the tube segment 16*a* being secured against falling out by lateral vertically extending wall segments 14*a* of the half shell. Preferably, the receiving width (d') at the upper edge of the wall segment is less than the lower receiving width (d) whereby a clamping effect results which secures the seated cleaning lance 16.

Figure 11:
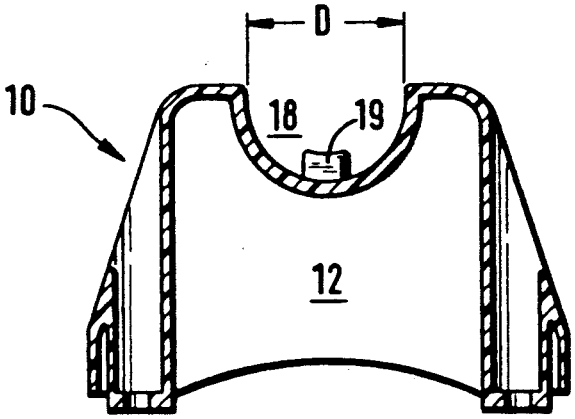
FIG. 11 is a section view taken along line C—C of FIG. 8.
Figure 12:
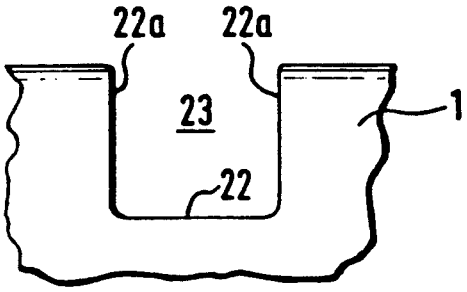
FIG. 12 is a partial view of the housing viewed in the direction of arrow D shown in FIG. 6.

The receptacle 18 lying on the one end of the half shell is likewise configured as a half shell as shown in FIG. 11. The receiving width D of the receptacle 18 is greater than the receiving width (d) of the half shell of the handle bridge 14. The receiving width D is adapted to the outer diameter of the connecter 16*c*. A raised stop 19 is formed at the end of the connecter 16*c* facing away from the handle bridge 14. The stop 19 is formed on the base of the half shell of the holder 18. The spacing (u) of the stop 19 to the annular shoulder 20, which is configured at the transition to the handle bridge 14, is then greater than the length L of the connecter 16*c*. The height of the stop 19 is provided such that the stop extends up to the support surface of the holder 11 in the handle bridge.

The holder 17 formed at the other end of the handle bridge 14 in the handle post 13 has essentially a rectangular cross section having the receiving width D. An annular shoulder 20 is again formed at the transition to the half shell of the handle bridge 14. The side walls 17*a* of the receptacle extend essentially in the vertical direction and pass at right angles into the base 17*b* of the receptacle 17. The base 17*b* forms a step 17*c* and extends into the half shell of the handle bridge 14 and drops off, preferably continuously, to the open end of the receptacle 17.

Support ribs 21 are provided in the base of the half shell of the handle bridge 14 and extend in the longitudinal direction. In the embodiment shown, three vertical support ribs are arranged so as to be parallel one to the other.

Figure 4:
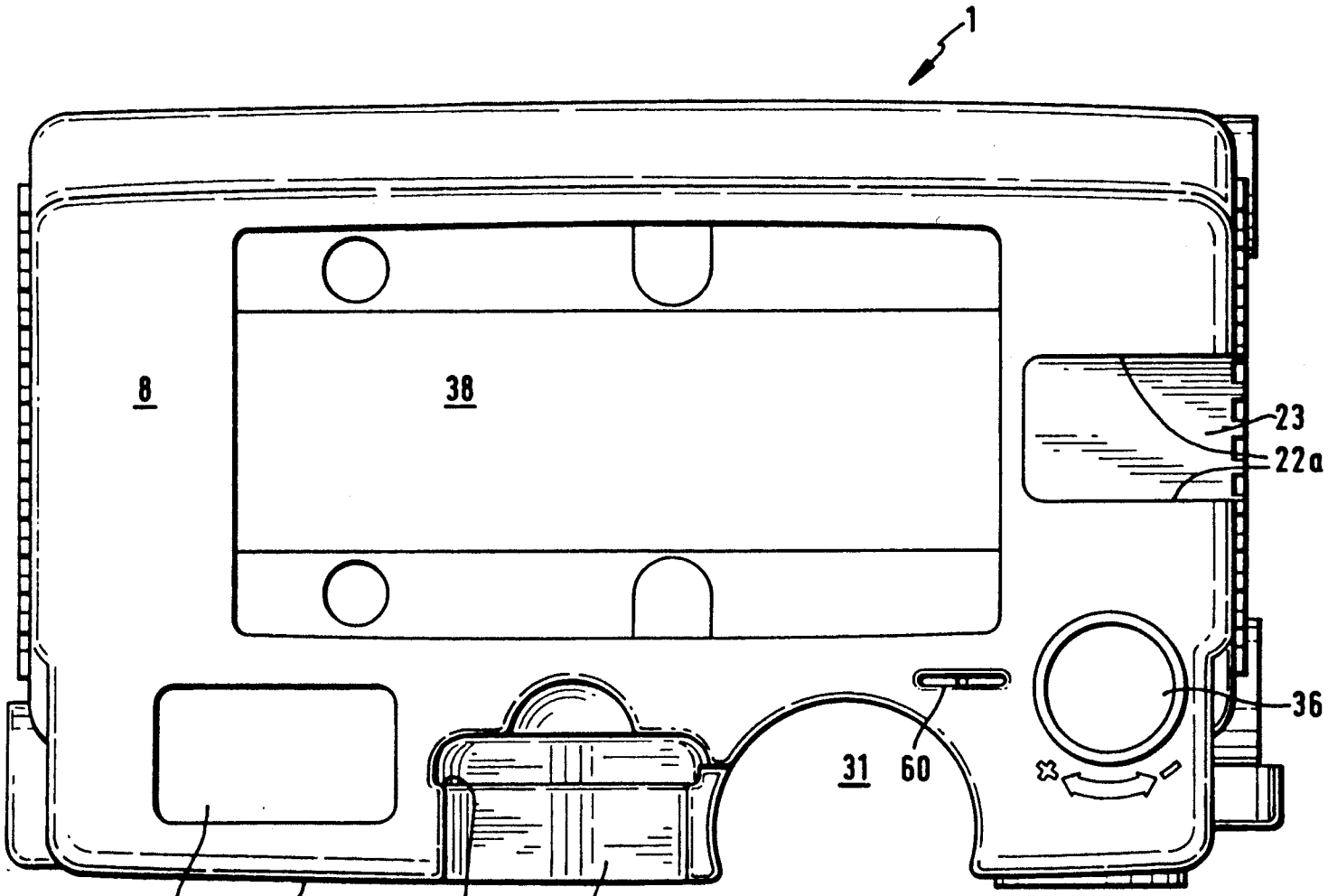
FIG. 4 is a plan view of the upper housing half of the housing of FIG. 1.
Figure 5:
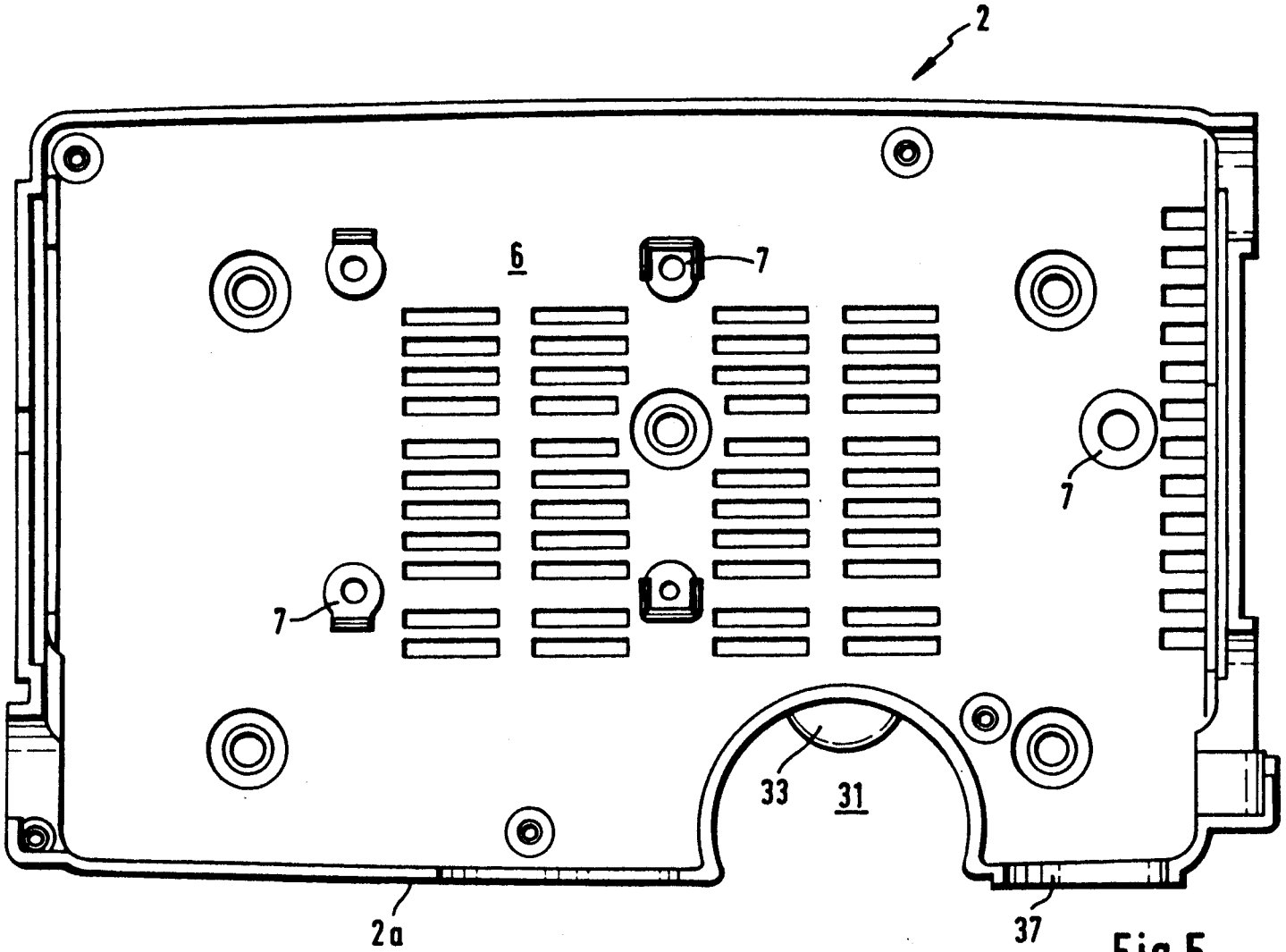
FIG. 5 is a plan view of the lower housing half of the housing of FIG. 2.

As shown in FIG. 2, the carrying handle is fixed to the upper housing half 1 in such a manner that the base 22 of a cutout 23 provided in the upper housing half 1 lies as an extension of the base 17*b* of the receptacle 17 in the carrying handle. The base plate 9 preferably lies in an appropriately adapted depression 38 in the outer surface 8 of the cover (FIGS. 3 and 4). The bases 17*b* and 22 are in alignment with each other. Likewise, the vertical side walls 17*a* of the receptacle 17 are in alignment with the vertical side walls 22*a* of the housing cutout 23.

The carrying handle 10 is fixed with four screws to the upper housing half. Two screws are disposed in the region of the handle post 12 and two additional screws lie on both sides of the handle bridge at approximately half the length of the base plate 9. The screws engage in threaded bores of the motor mounted in the housing whereby the carrying handle is attached directly to the motor block.

If a bottle 26 for a cleaning agent is threadably connected to the connecter 16*c*, then the cleaning lance 16 is placed on the support 15 in such a manner that the forward handle segment 16*d* lies against the base 17*b* of the receptacle 17 or against the base 22 of the housing cutout 23 and the connecter 16*c* lies outside of the receptacle 18. The bottle 26 for the cleaning agent is then forward of the end face 5. A reliable and tilt-free mounting of the cleaning lance 16 with the threadably attached bottle 26 for the cleaning agent is thereby reliably ensured. The tubular segment 16*a* then lies in the receptacle 11 of the handle bridge 14 as well as against the stop 19.

Figure 13:
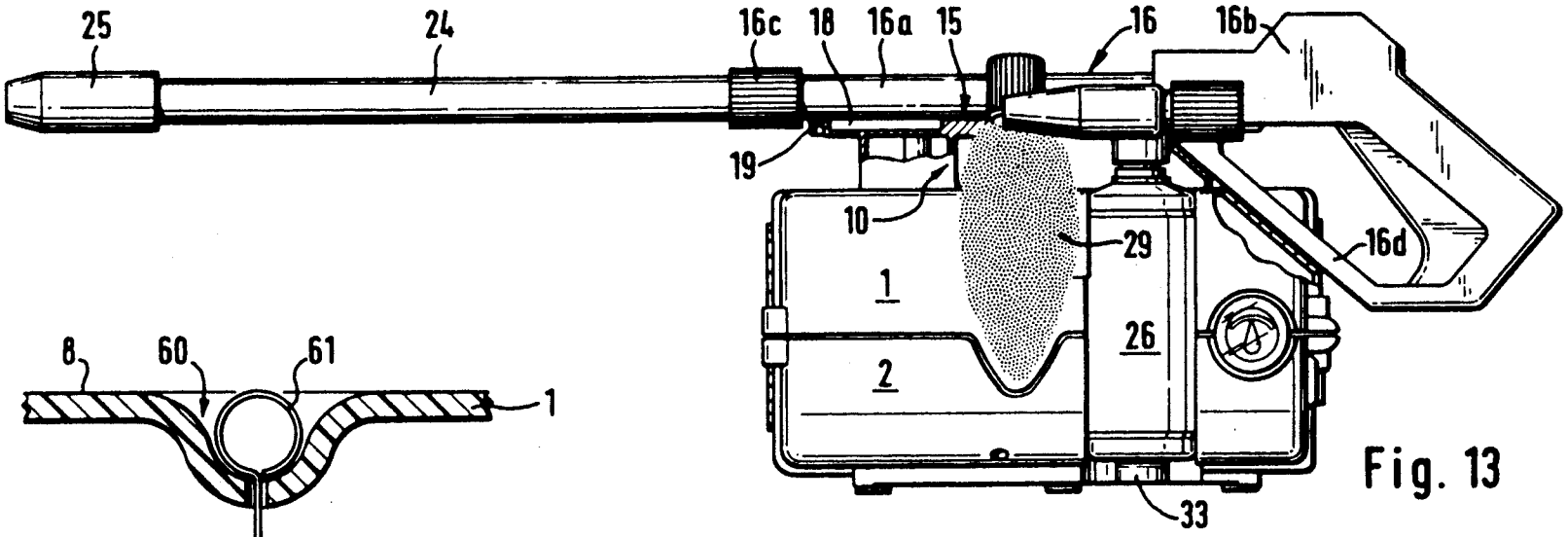
FIG. 13 is a side elevation view of the housing corresponding to the view of FIG. 2 showing an extended cleaning lance mounted in the holder of the handle.
Figure 14:
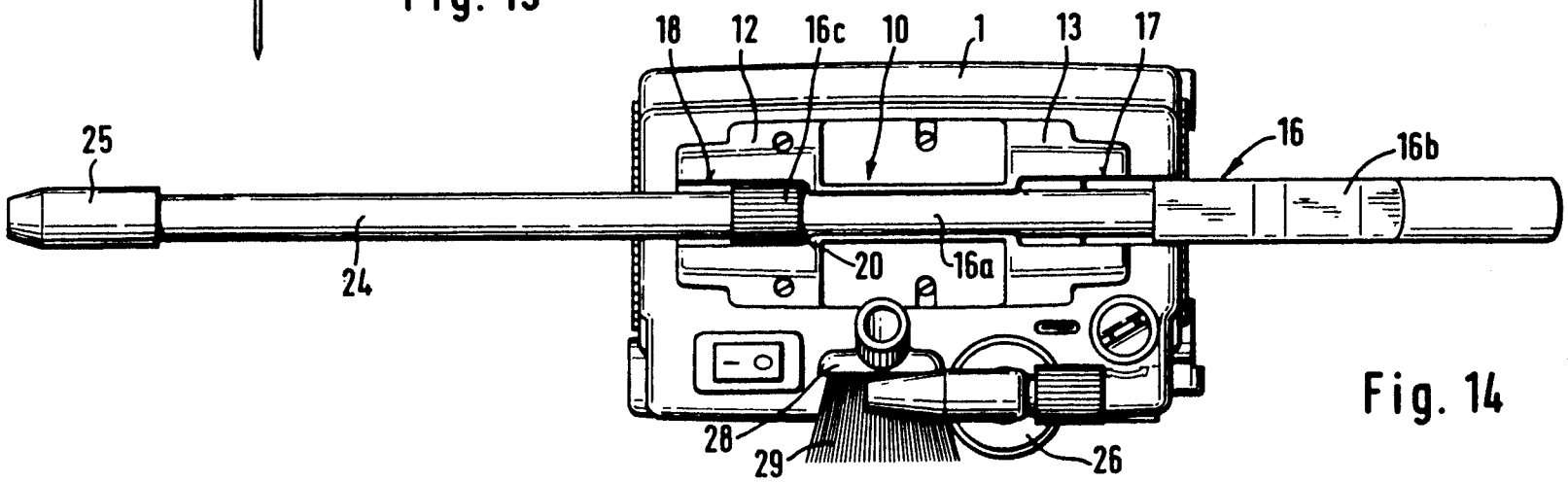
FIG. 14 is a plan view of the housing of FIG. 13 showing the cleaning lance placed in the holder in another position; and, FIG. 15 is a section view taken along line E—E of FIG. 3.

If in lieu of the bottle 26, an extension tube 24 having a cleaning nozzle 25 is connected to the connecter 16*c*, then the support can take place in a position as that shown in FIG. 13. However, the cleaning lance 16 can tend to tilt out of the holder 15 and lift the handle 16*b* because of the weight of the extension tube 24 and the cleaning nozzle 25 with the tilting action taking place in dependence upon the dimensions of the extension tube 24. This action can be prevented by a support position of the cleaning lance which is shifted rearwardly as shown in FIG. 14. In this second support position, the connecter 16*c* lies in the receptacle 18 where it is prevented from slipping out axially by the annular shoulder 20, on the one hand, and, on the other hand, by the stop 19. The cleaning lance is held in the support 11 so as to be clamped by the reduced receiving width (d') as shown in FIG. 10.

The housing of the invention for the high-pressure cleaning apparatus further includes at least one vertical receptacle for an accessory part such as a cleaning brush, bottle for holding a cleaning agent or the like. This vertical receptacle is disposed in a side wall at least in the upper housing half 1. In the embodiment shown, a receptacle 30 for a cleaning brush 29 and a receptacle 31 for a bottle 26 for a cleaning agent are provided in the one longitudinal wall 1*a* (FIG. 6) of the upper housing half 1.

Figure 6:
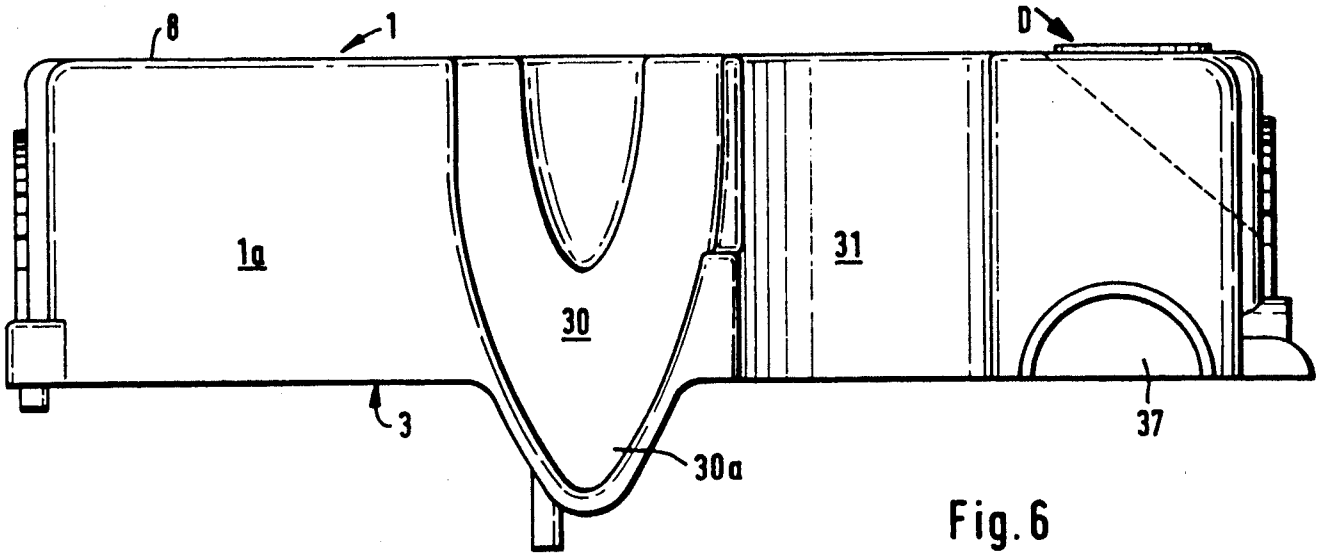
FIG. 6 is a side elevation view of the upper housing half of FIG. 4.
Figure 15:
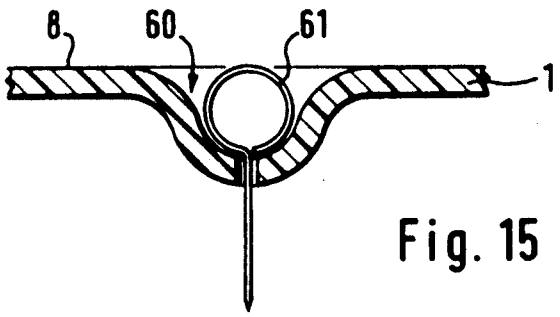

In addition, in the surface 8 of the cover of the upper housing half 1, a receptacle 60 is provided for a cleaning needle 61 as shown in FIGS. 3 and 4. This needle is shown in the enlarged view of FIG. 15. The receptacle 30 (FIG. 6) is provided as being integral in the housing half 1 and holds a brush carrier 28 of the cleaning brush 29 (FIG. 3). For this purpose, a recess 32 is provided in the side wall 1*a* as shown in FIG. 6 and which is adapted to the shoe-like configuration of the brush carrier 28. The receptacle 30 is open in the vertical direction at the end thereof facing toward the handle so that the cleaning brush 29 can be placed in the receptacle 30 from the handle side and is held in the receptacle by gravity. The depression 32 engages the shoe-shaped brush holder 28. The bristles project laterally out of the receptacle 30.

Figure 7:
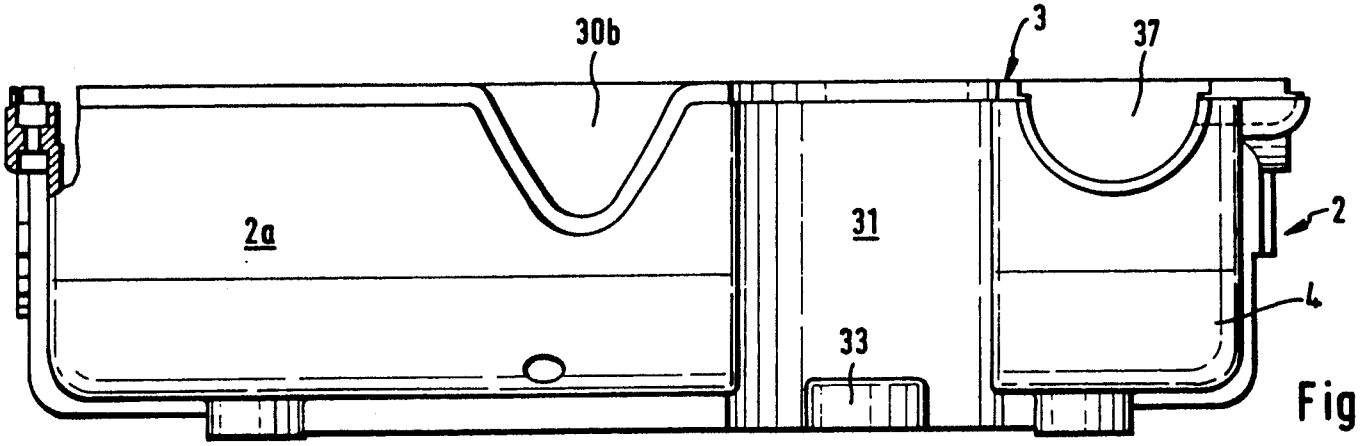
FIG. 7 is a side elevation view of the lower housing half of FIG. 5.

As shown in FIG. 6, the receptacle 30 is configured over its entire elevation in the longitudinal wall 1*a* of the upper housing half 1. The tip 30*a* of the receptacle 30 extends over the partition plane 3 and engages into a corresponding cutout 30*b* in the side wall 2*a* of the lower housing half 2 when the housing halves are put together as shown in FIG. 7.

The receptacle 31 lies next to the receptacle 30 for the cleaning brush 29. The receptacle 31 is provided for the bottle 26 for the cleaning agent (FIG. 2). This receptacle is configured as a vertical partial cylinder which extends over the entire height of the housing and is open toward the housing side wall. As shown in the plan view, the partial cylinder lying vertically defines a peripheral angle of somewhat more than 180° in order to prevent the bottle from dropping out of the receptacle 31 laterally. The peripheral angle is 220° in the embodiment shown. As shown in FIGS. 7 and 8, a projection 33 is provided in the lower housing half and this projection 33 projects into the receptacle 31. A bottle 26 is seated on the projection 33 vertically from the side of the carrying handle 10. The projection 33 then forms the base of the receptacle 31 (FIG. 3).

In addition to the receptacles described, additional cutouts 35 and 36 are provided for service and control elements 35*a* and 36*a*, respectively, in the surface of the cover of the upper housing half 1. As shown in the side elevation views of the longitudinal sides of the housing of FIGS. 6 and 7, a half circular-shaped recess 37 lies between the end face 4 and the receptacle 31 and is provided for seating a round instrument 37*a* (FIG. 2).

It is understood that the foregoing description is that of the preferred embodiments of the invention and that various changes and modifications may be made thereto without departing from the spirit and scope of the invention as defined in the appended claims.

What is claimed is:

1. A housing for a high-pressure cleaning apparatus for accommodating a high-pressure pump, drive motor and other components of the apparatus coacting therewith, the apparatus having a cleaning lance and said housing comprising:

a trough-like lower housing half having a base wall adapted to support said pump and said motor;

a trough-like upper housing half for closing off and covering said lower housing half;

said lower and upper housing halves conjointly defining a horizontal partition interface where said housing halves are mutually joined;

said upper housing half having a top wall defining an outer side facing away from said base wall;

a carrying handle disposed on said outer side for enabling an operator to carry said apparatus;

support means provided on said outer side of said top wall to support said carrying handle in spaced relationship to said top wall;

said housing defining a longitudinal axis and being configured to correspond in shape essentially to a right parallelopiped;

said carrying handle being configured to have a holder formed therein for holding the cleaning lance; and, said carrying handle and said holder being aligned approximately parallel to said axis.

2. The housing of claim 1, said cleaning lance having a tube outer diameter; and, said support means including two posts provided on said outer side spaced apart from each other and said carrying handle including a bridge connected between said posts, said holder including a support formed as a half shell in said bridge; said support having respective open longitudinal ends and having an upper width (d') and a lower width (d) adapted to said tube outer diameter and said upper width (d') being less than said tube outer diameter.

3. The housing of claim 1, said apparatus further having accessory parts; said two housing halves conjointly defining a side wall; and, receiving means formed in said side wall for accommodating at least one of said accessory parts.

4. A housing for a high-pressure cleaning apparatus for accommodating a high-pressure pump, drive motor and other components of the apparatus coacting therewith, the apparatus having a cleaning lance and said housing comprising:

a trough-like lower housing half having a base wall adapted to support said pump and said motor;

a trough-like upper housing half for closing off and covering said lower housing half;

said lower and upper housing halves conjointly defining a horizontal partition interface where said housing halves are mutually joined;

said upper housing half having a top wall defining an outer side facing away from said base wall;

a carrying handle disposed on said outer side for enabling an operator to carry said apparatus;

said carrying handle being configured as a holder for holding the cleaning lance;

said cleaning lance having a tube outer diameter;

said carrying handle having post means and a bridge connected to said post means, said holder including a support formed as a half shell in said bridge; said support having respective open longitudinal ends and having an upper width (d') and a lower width (d) adapted to said tube outer diameter and said upper width (d') being less than said tube outer diameter;

said half shell defining a longitudinal axis and having a base; and, said half shell further having a plurality of supporting ribs formed on said base so as to extend in the direction of said longitudinal axis of said half shell.

5. The housing of claim 4, said supporting ribs being mutually parallel and being configured so as to extend vertically upwardly from said base; and, said supporting ribs being three in number.

6. A housing for a high-pressure cleaning apparatus for accommodating a high-pressure pump, drive motor and other components of the apparatus coacting therewith, the apparatus having a cleaning lance and said housing comprising:

a trough-like lower housing half having a base wall adapted to support said pump and said motor;

a trough-like upper housing half for closing off and covering said lower housing half;

said lower and upper housing halves conjointly defining a horizontal partition interface where said housing halves are mutually joined;

said upper housing half having a top wall defining an outer side facing away from said base wall;

a carrying handle disposed on said outer side for enabling an operator to carry said apparatus;

said carrying handle being configured as a holder for holding the cleaning lance;

said cleaning lance having a tube outer diameter;

said carrying handle having post means and a bridge connected to said post means, said holder including a support formed as a half shell in said bridge; said support having respective open longitudinal ends and having an upper width (d') and a lower width (d) adapted to said tube outer diameter and said upper width (d') being less than said tube outer diameter;

said post means including two posts at respective ends of said bridge for connecting said bridge to said outer side of said top wall; said posts being formed to have first and second receptacles as respective extensions of said support; and, said receptacles each having a receiving width (D) greater than said lower width (d) of said support.

7. The housing of claim 6, said first receptacle being formed so as to have a configuration corresponding to a half shell.

8. The housing of claim 7, said first receptacle having an end facing away from said bridge; and, said first receptacle further having a base and a raised stop formed on said base of said first receptacle; and, said raised stop being disposed at said one end of said first receptacle.

9. The housing of claim 8, said second receptacle having an open end facing away from said bridge and said second receptacle having a base which drops off to said open end.

10. The housing of claim 9, said upper housing half having a cutout formed therein at said open end of said second receptacle; and, said cutout having a base which extends from and is in alignment with said base of said second receptacle.

11. A housing for a high-pressure cleaning apparatus for accommodating a high-pressure pump, drive motor and other components of the apparatus coacting therewith, the apparatus having a cleaning lance and said housing comprising:

a trough-like lower housing half having a base wall adapted to support said pump and said motor;

a trough-like upper housing half for closing off and covering said lower housing half;

said lower and upper housing halves conjointly defining a horizontal partition interface where said housing halves are mutually joined;

said upper housing half having a top wall defining an outer side facing away from said base wall;

a carrying handle disposed on said outer side for enabling an operator to carry said apparatus;

said carrying handle being configured as a holder for holding the cleaning lance;

said apparatus further having accessory parts;

said two housing halves conjointly defining a side wall;

receiving means formed in said side wall for accommodating at least one of said accessory parts; and, said side wall being a longitudinally extending side wall and said receiving means being recesses formed in said side wall so as to be open laterally thereof.

12. The housing of claim 11, said partition interface defining a partition plane; and, said recesses extending approximately perpendicularly to said partition plane and having respective openings facing toward said carrying handle.

13. The housing of claim 12, said accessory parts including a cleaning brush having a brush carrier having bristles fixed on said brush carrier; a first one of said recesses being adapted to accommodate said brush carrier and being formed in said upper housing half so as to have a recess tip; and, said recess tip being disposed in said upper housing half so as to extend below said partition plane.

14. The housing of claim 13, said lower housing half having a cutout formed therein for receiving said recess tip therein.

15. A housing for a high-pressure cleaning apparatus for accommodating a high-pressure pump, drive motor and other components of the apparatus coacting therewith, the apparatus having a cleaning lance and said housing comprising:

a trough-like lower housing half having a base wall adapted to support said pump and said motor;

a trough-like upper housing half for closing off and covering said lower housing half;

said lower and upper housing halves conjointly defining a horizontal partition interface where said housing halves are mutually joined;

said upper housing half having a top wall defining an outer side facing away from said base wall;

a carrying handle disposed on said outer side for enabling an operator to carry said apparatus;

said carrying handle being configured as a holder for holding the cleaning lance;

said apparatus further having accessory parts;

said two housing halves conjointly defining a side wall;

receiving means formed in said side wall for accommodating at least one of said accessory parts; and, a second one of said recesses being formed in said side wall so as to define a part cylindrical surface for accommodating said vessel; and, said second one of said recesses defining a peripheral angle greater than 180°.

16. The housing of claim 13, said peripheral angle being 220°.

17. The housing of claim 15, said second one of said recesses extending over the entire elevation of said housing and having a lower end in said lower housing half; and, said lower housing half having a projection formed thereon at least partially closing said second one of said recesses at said lower end thereof.

* * * * *

UNITED STATES PATENT AND TRADEMARK OFFICE

CERTIFICATE OF CORRECTION

PATENT NO. : 5,320,281

DATED : June 14, 1994

INVENTOR(S) : Werner Hartmann, Karl-Heinz Klöpfer and Gerhard Zerrer

It is certified that error appears in the above-identified patent and that said Letters Patent is hereby corrected as shown below:

In column 8, line 60: delete "claim 13," and substitute -- claim 15, -- therefor.

Signed and Sealed this

Sixth Day of September, 1994

*Attest:*

*Attesting Officer*

Bruce Lehman

BRUCE LEHMAN

*Commissioner of Patents and Trademarks*